US006113743A

United States Patent [19]

Vice et al.

[11] Patent Number: 6,113,743

[45] Date of Patent: Sep. 5, 2000

[54] END DAM FOR WATERBOX OF PAPER MAKING MACHINE

[76] Inventors: Gerald Vice, 4301 Kasper Rd., Pascagoula, Miss. 39581; John Kenneth Huddleston, P.O. Box 692, Escatawpa, Miss. 39552

[21] Appl. No.: 09/333,898

[22] Filed: Jun. 16, 1999

[51] Int. Cl.[7] ..... D21H 23/34

[52] U.S. Cl. ..... 162/361; 118/410; 118/419

[58] Field of Search ..... 162/265, 361, 162/206; 118/410, 419

[56] References Cited

U.S. PATENT DOCUMENTS

| | | | |
|---|---|---|---|
| 4,259,921 | 4/1981 | Wallsten | 118/206 |
| 4,327,662 | 5/1982 | Damrau | 118/410 |
| 4,354,452 | 10/1982 | Patterson | 118/413 |
| 4,358,481 | 11/1982 | Wallsten | 427/211 |
| 4,426,412 | 1/1984 | Gerbert et al. | 427/356 |
| 4,434,194 | 2/1984 | Gerbert et al. | 427/356 |
| 4,503,804 | 3/1985 | Damrau | 118/410 |
| 4,706,603 | 11/1987 | Wohlfeil | 118/410 |
| 5,795,393 | 8/1998 | Isfort | 118/413 |

*Primary Examiner*—Laura Edwards
*Attorney, Agent, or Firm*—George L. Williamson

[57] ABSTRACT

The present invention discloses a pair of end dams for use on a waterbox on a papermaking machine. The end dam has a front curved foot-like structure having a mounting bracket on its back side for attachment to the backside of the waterbox while the curved end has a packing material on its underside which comes into contact with the steel roll of the papermaking machine. The packing material serves as an end dam communicating between the pond level control dam located on the forward shelf of the waterbox and the leading edge of the steel roll in such a way that the liquids are retained within the waterbox instead of being spilled onto the surrounding floor. The end dam of the present invention is secured to the waterbox with a screw-type clamp.

13 Claims, 6 Drawing Sheets

END DAM FOR WATERBOX OF PAPER MAKING MACHINE

BACKGROUND OF THE INVENTION

1. Field of the Invention

The present invention relates generally to end dams and, more particularly, to an end dam for use on a waterbox of a paper making machine.

2. Description of the Prior Art

End dams have been described in the prior art. However, none of the prior art discloses the unique features of the present invention.

In U.S. Pat. No. 4,434,194, dated Feb. 28, 1984, Gerbert, et al., disclosed an edge dam assembly for an applicator for applying a film of coating material on a moving web of paper carried through an application zone, characterized by a seal element at each side end of the zone. To prevent leakage of coating liquid past the seal element, air is introduced through the element and into the side end of the zone adjacent to the element. The air forms an air barrier pocket at the side end of the zone, which is void of coating liquid, whereby coating liquid is maintained in the zone inwardly of the seal elements.

In U.S. Pat. No. 4,426,412, dated Jan. 17, 1984, Gebert, et al., disclosed an edge dam for an applicator for applying a film of coating liquid to a moving web of paper carried through an application zone, characterized by a seal element at each side end of the zone for substantially sealing the side end of the zone, thereby to impede a flow of coating material out of the zone. At least one orifice is formed through the seal element outwardly of the zone, and the orifice is connected with a supply of water under pressure for directing a flow of water against the peripheral edge of the web moving therepast, thereby to wet the edge and flush the same of any coating material seeping past the element. In consequence, edge tickers and coating liquid pickup on the web edge are substantially eliminated.

In U.S. Pat. No. 4,358,481, dated Nov. 9, 1982, Wallsten disclosed a method and apparatus for coating both sides of a moving web, such as a paper web, with the same coating material on both sides by feeding the web downwardly between a rotating support roller and a coating blade directed against said roller. One side of the web is partially wrapped around said roller and a first excess of coating material intended for the web side facing said roller is applied to the roller before or at the point of contact between said web and the roller. A second excess of coating material is applied to the other side of the web by feeding the web through a dam of coating material arranged below said contact point—in the moving direction of the web—said dam being formed substantially between said coating blade and holder and the said other side of the web. The excess coating material is laterally expressed in said dam beneath the top level thereof.

In U.S. Pat. No. 4,706,603, dated Nov. 17, 1987, Wohlfeil disclosed a coating apparatus for fabric webs carried along a counter roll including an applicator which accommodates a chamber containing coating color to be applied onto the fabric web. The chamber is defined by spaced doctor blade and overflow plate and dam elements laterally sealing the chamber. For preventing a coating of the web along its edges, separate doctor assemblies are provided which are controlled independently of the dam plates.

In U.S. Pat. No. 4,259,921, dated Apr. 7, 1981, Wallsten disclosed an apparatus selectively convertible to perform one or more coating operations on a web of paper or the like comprising a fixed rotatable roller, a coating blade movable into and out of coating relation with the surface of the fixed roller and cooperating with a dam of coating material to coat a web as it passes through the nip between the coating blade and the fixed roller, and a second movable roller movable into and out of nip forming relation with the fixed roller with provision for adjustment of pressure in the nip and adapted to cooperate with a dam of coating material to coat a web as it passes through the nip between said rollers, said movable roller also being adapted alternatively to receive coating material and to transfer it to the fixed roller to coat one side of a web as it runs over the latter.

In U.S. Pat. No. 5,795,393, dated Aug. 18, 1998, Isfort disclosed a coating edge limiter for a coating arrangement with a short dwell time. Color is fed under pressure into a coating chamber formed by a backing roll around which a paper web is guided, a barrier wall, a doctor blade element and sealing blocks located at both ends of the coater. A formatting plate almost completely covers an application zone between the doctor blade element and the barrier wall so that an edge region of the web is sharply delineated and kept completely free of color. In each of the sealing blocks water is supplied via channels to depressions thereby forming a pressure cushion. This pressure cushion prevents the pressurized color to the coating chamber from flowing out laterally and ensures that the formatting plate is pressed flatly against the web. The coating edge limiter thereby makes it possible to establish very precisely the width of the web to be produced.

In U.S. Pat. No. 4,503,804, dated Mar. 12, 1985, Damrau disclosed an improved edge seal assembly for an applicator for applying a coating liquid to a moving web of paper, wherein the applicator is of the type having a chamber for receiving the coating liquid and an elongate opening thereto for directing the liquid onto the web, the opening being formed between a front wall of the chamber and a doctor blade extending from the rear side of the opening to against the web, characterized by a seal element sealed with the front wall and doctor blade in an end space therebetween, and a deckle beneath the seal element for closing off a selected portion of the side end of the opening. The seal element and the deckle are slidingly interconnected and can be independently adjusted laterally with respect to the opening.

In U.S. Pat. No. 4,327,662, dated May 4, 1982, Damrau disclosed an improved edge or end dam assembly for an applicator for applying a coating liquid to a web of moving paper carried on a backing roll, the applicator being of the type having a chamber for receiving the coating liquid and an opening therein for directing the liquid onto the web, the opening being formed between a front wall of the chamber and a doctor blade, extending from the rear of the opening to against the web, characterized by a seal element sealed with the front wall and doctor blade in an end space therebetween and extending toward and closely adjacent but spaced from the web. The face of the seal element adjacent the paper web has a plurality of grooves extending generally parallel to the direction of movement of the web, so that coating material which seeps past the seal element and beyond the edge dam assembly enters the grooves and is moved by the web toward the doctor blade for deposit on the web. In this manner, leakage of coating material past the seal element is significantly minimized, and pressure of coating material on the web may be maintained.

In U.S. Pat. No. 4,354,452, dated Oct. 19, 1982, Patterson disclosed an edge dam or edge seal assembly for an applicator for applying a coating liquid to a moving web of paper carried on a backing roll, the applicator being of the type having a chamber for receiving coating liquid and an opening therein for directing the liquid onto the web, the opening being formed between a front wall of the chamber and a doctor blade extending from the rear of the opening to against the web, characterized by an expandable seal element sealed with the front wall and doctor blade in an end space therebetween and extending toward and closely adjacent to but spaced from the web. The seal element is of a flexible material and accommodates the introduction of pneumatic or hydraulic fluid under pressure therein for expanding the same to a size which fits the end space and seals the same, and which extends a sealing surface of the element very closely adjacent to the web or backing roll. Consequently, leakage of coating past the seal element may be accurately controlled and significantly minimized.

While these end dams may be suitable for the purposes for which they were designed, they would not be as suitable for the purposes of the present invention, as hereinafter described.

SUMMARY OF THE INVENTION

The present invention discloses a pair of end dams for use on a waterbox on a papermaking machine. The end dam has a front curved foot-like structure having a mounting bracket on its back side for attachment to the backside of the waterbox while the curved end has a packing material on its underside which comes into contact with the steel roll of the papermaking machine. The packing material serves as an end dam communicating between the pond level control dam on the forward shelf of the waterbox and the leading edge of the steel roll in such a way that the liquids are retained within the waterbox instead of being spilled onto the surrounding floor. The end dam of the present invention is secured to the waterbox with a screw-type clamp.

An object of the present invention is to provide an end dam in order to keep liquid retained within the waterbox of the papermaking machine. Another object of the present invention is to avoid spillage of the liquid onto the floor surrounding the papermaking machine in order to keep the floor clean. Another object of the present invention is to provide a safety device for workers in order to prevent and reduce exposure of workers to in-running nip points and injuries resulting from the hand of a worker contacting the in-running nip point between the steel rolls. A further object of the present invention is to provide a high quality paper by keeping the material liquid in a more uniform fashion about the paper which is being run between the steel rolls, by providing a narrow dry edge resulting in a wider sellable sheet of paper, by reducing paper breaks, reducung coater blade edge burning and reducing corrugation on the reel of paper. An added benefit is elimination of the use of grease head end dams currently in wide use which are hand made with grease and cotten fibers and manually installed.

The foregoing and other changes will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designated the same or similar part throughout the several views.

The following detailed description is, therefore, not to be taken in a limiting sense, and the scope of the present invention is best defined by the appended claims.

BRIEF DESCRIPTION OF THE DRAWINGS

In order that the invention may be fully understood, it will now be described, by way of example, with reference to the accompanying drawings in which.

LIST OF REFERENCE NUMERALS

Figure 1:
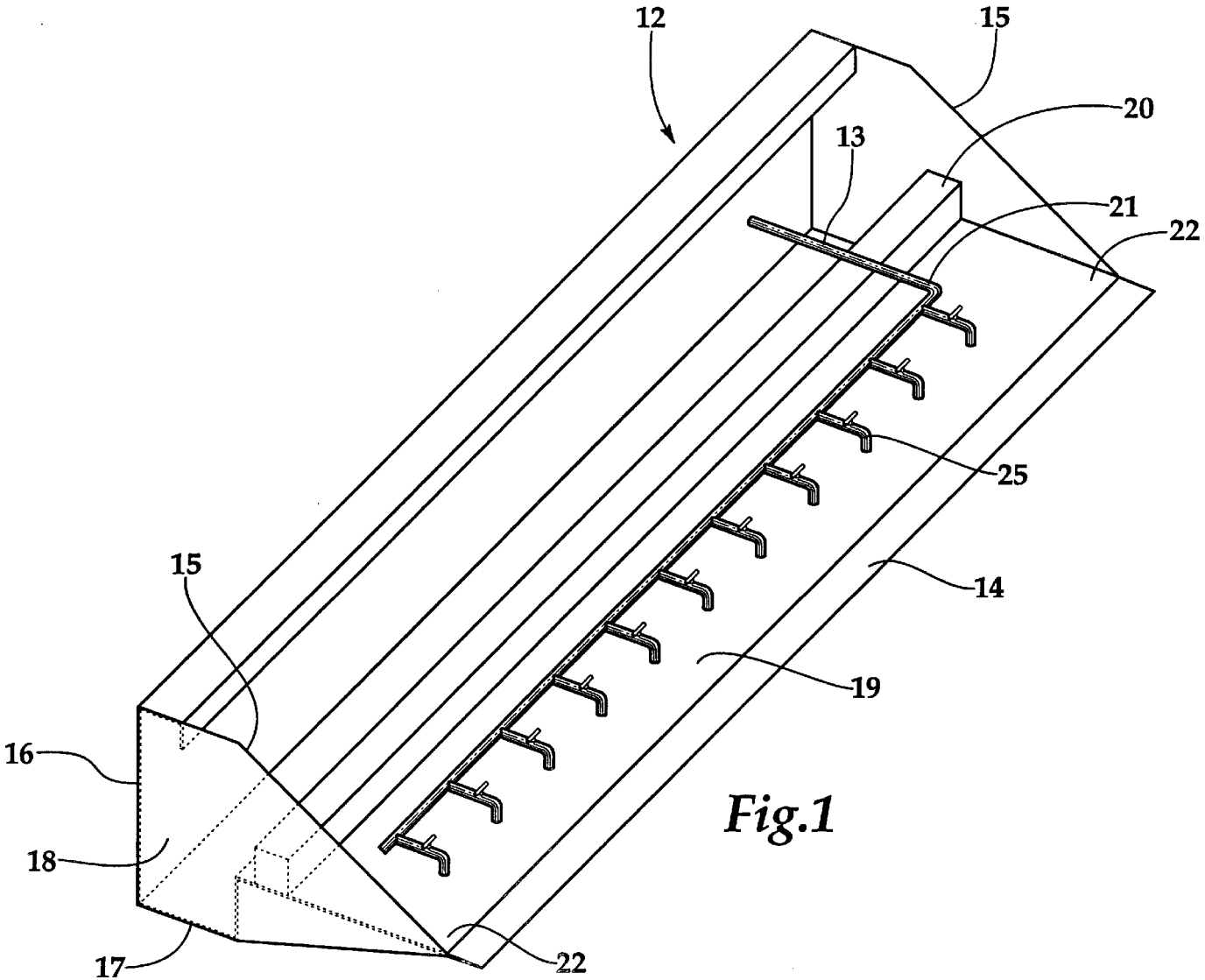
FIG. 1 is a perspective view of the waterbox of a papermaking machine.

With regard to the reference numerals used, the following numbering is used throughout the drawings.

10 present invention
12 waterbox
13 header
14 rubber lip
15 end piece of waterbox
16 back edge of waterbox
17 bottom of waterbox
18 return basin
19 forward projection of waterbox
20 pond level control dam
21 conduit
22 waste point
23 flange member
24 clamp means
25 nozzle
26 back edge of end dam
28 main body of end dam
29 curved portion
30 packing material
31 means for attaching
32 threads
34 foot-like portion
35 lower steel roll
36 return drain
38 paper
40 direction arrow
42 steel rolls
44 calendar stack
46 guide roll
48 valve
50 axle

52 flange
54 pins
56 clamp handle
58 channel
60 means for attachment
62 spring means
64 means for attachment

DESCRIPTION OF THE PREFERRED EMBODIMENT(S)

Turning now descriptively to the drawings, in which similar reference characters denote similar elements throughout the several views, FIGS. 1 through 9 illustrate the present invention being an end dam for use on waterboxes of papermaking machines.

Turning to FIG. 1, therein is shown a perspective view of a waterbox 12 which box is several feet in length and is located in the horizontal plane adjacent to a steel roll (not shown) of the papermaking machine (not shown). The waterbox 12 has a flexible rubber lip 14 which contacts the lower steel roll on its front edge over which lip 14 liquid from the waterbox 12 passes toward the steel roll and the paper which is running between and in contact with the steel rolls of the papermaking machine. The waterbox 12 is a reservoir for starch-based fluid which reservoir is formed by rear surface 16, two end pieces 15 on each end, a bottom 17 and pond level control dam 20 located on a forwardly projecting shelf-like edge or portion 19 of the waterbox 12 to which the rubber lip 14 is attached. The waterbox has a back side or edge 16 which forms the rear edge of the waterbox return basin 18 which forms a reservoir in which liquid is contained within the waterbox 12. The waterbox 12 also has a pond level control dam 20 which retains the liquid in the waterbox 12 and a waste point 22 where the liquid from the waterbox can pass around the edges of each end of the waterbox 12. The waterbox 12 can be several feet, e.g., 18 to 20 feet in width. Also shown is the header 13 for the conduit 21 or line which conveys liquid to be delivered by the water box 12 by the plurality of nozzles 25.

Figure 2:
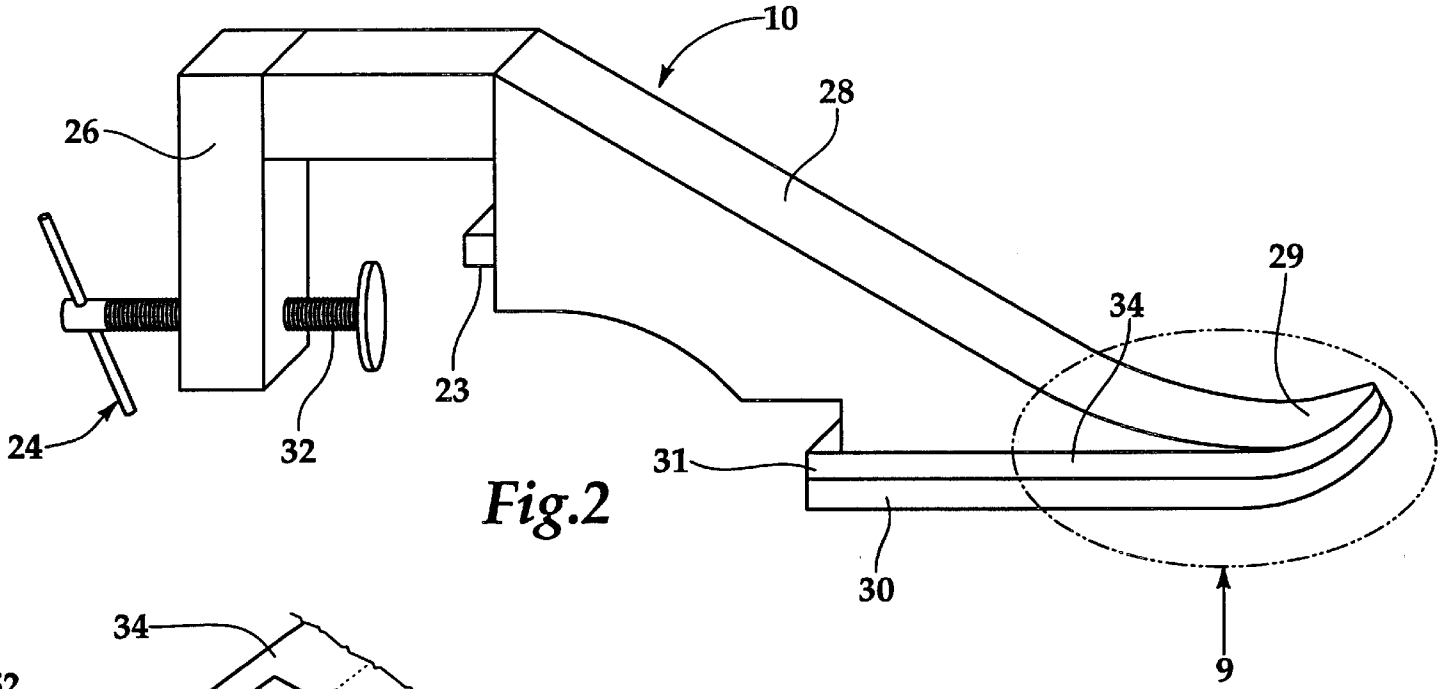
FIG. 2 is a persepective view of the present invention.

Turning to FIG. 2, therein is shown a perspective view of the present invention 10 showing the configuration of one embodiment of the present invention. The end dam 10 of the present invention has a main body piece 28 with a downwardly extending U-shaped clamp 24 on its back or rear side 26 which can be used to provide means to be clamped onto each end of the waterbox (not shown) and a forwardly disposed flange member 23 for gripping the front edge of the back side of the waterbox. The end dam has a forwardly extending and projecting leg-like or foot-like portion 34 along with a sealing or packing material 30 having means for attachment 31, which will be described in FIGS. 7 and 8, to the underside of the foot-like portion 34 which curves upwardly on its end 29 to accomplish or form a seal with the steel roll (not shown). Curved end 29 is important because it assists in effectively disposing packing material 30 firmly against the steel roll 35 (not shown) so as to form an end dam. In use, the end dam 10 is clamped onto the back upper edge of the waterbox 16 (not shown) so that it is located on the inside of each end piece 15 (not shown) of the waterbox thereby forming an end dam or seal at the end of the waterbox in the area of the waste point 22 (not shown). The clamp means 24 has threadable screw means 32 which allows it to be rotatably adjustable so as to tighten or loosen the present invention 10 on the waterbox. The packing material 30 is made of soft, pliable material or the like such as packing material used in a pump of the standard type which could be any suitable material as would be chosen in the standard manner by one skilled in the art.

Figure 3:
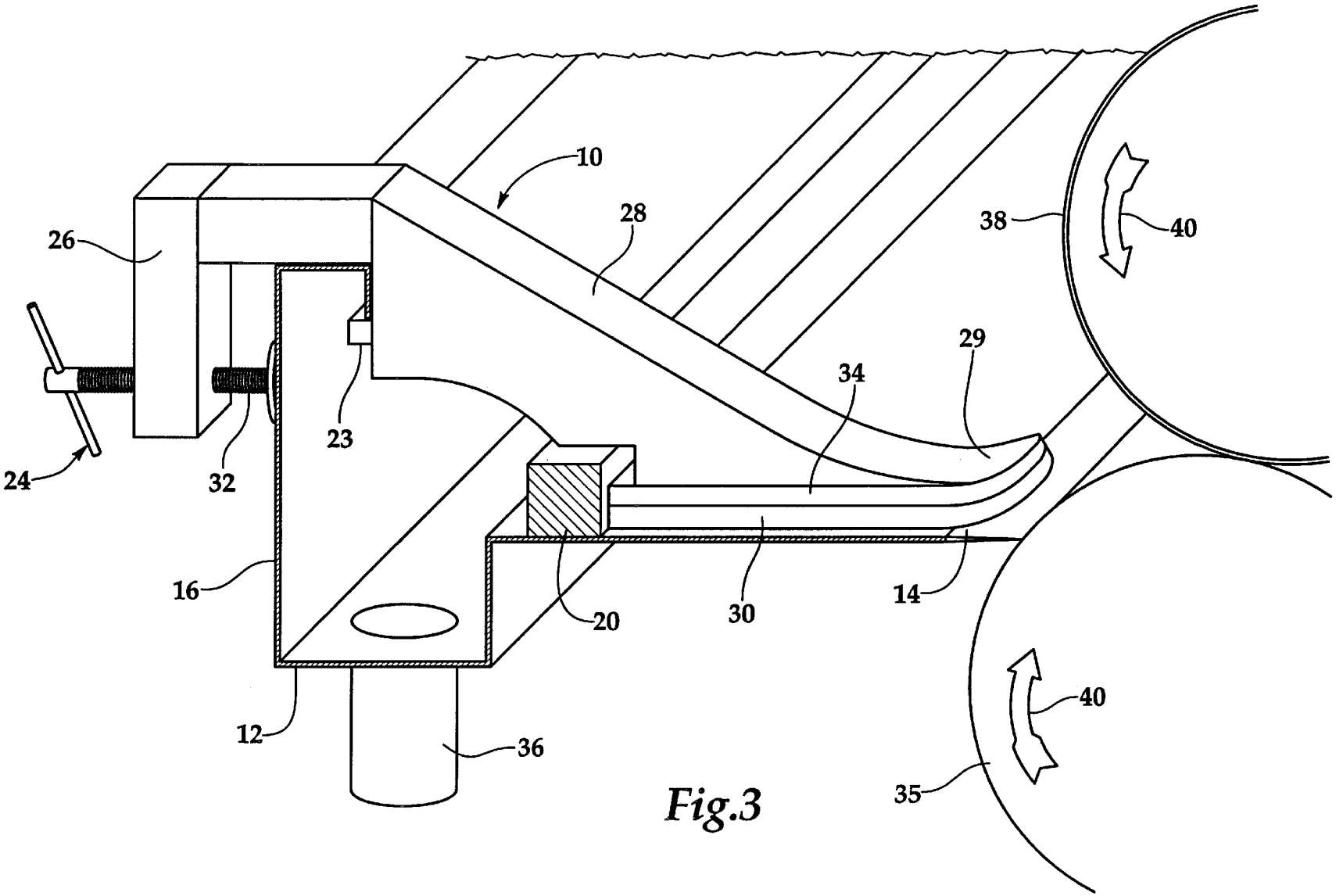
FIG. 3 is a persective view of the present invention in operative connection showing a waterbox in cross-section taken from just inside the end piece of FIG. 1.

Turning to FIG. 3, therein is shown a perspective view of the present invention in operative connection. The end dam 10 is clamped onto the back upper edge 16 of the waterbox 12 so that it is located on the inside of the waterbox 12 thereby having the foot-like portion 34 of the end dam 10 form a seal using packing material 30 which is located between the pond level control dam 20 and the steel roll 35 of the papermaking machine so that an end dam is formed by the packing material 30 preventing liquid from being wasted around, over, or about the edge of the end dam 10 and waterbox 12. With the end dam 10 in place the excess liquid runs back over the control dam into the return basin 18 of the waterbox 12 and then into the return drain 36. The packing material can be made of pliable, fabric-like material used for packing pumps or the like, which material is selected so that it will not scratch or damage the surfaces of the steel rolls. A film of paper 38 is shown on the steel roll and an arrow 40 showing the direction of rotation of the steel rolls.

Figure 4:
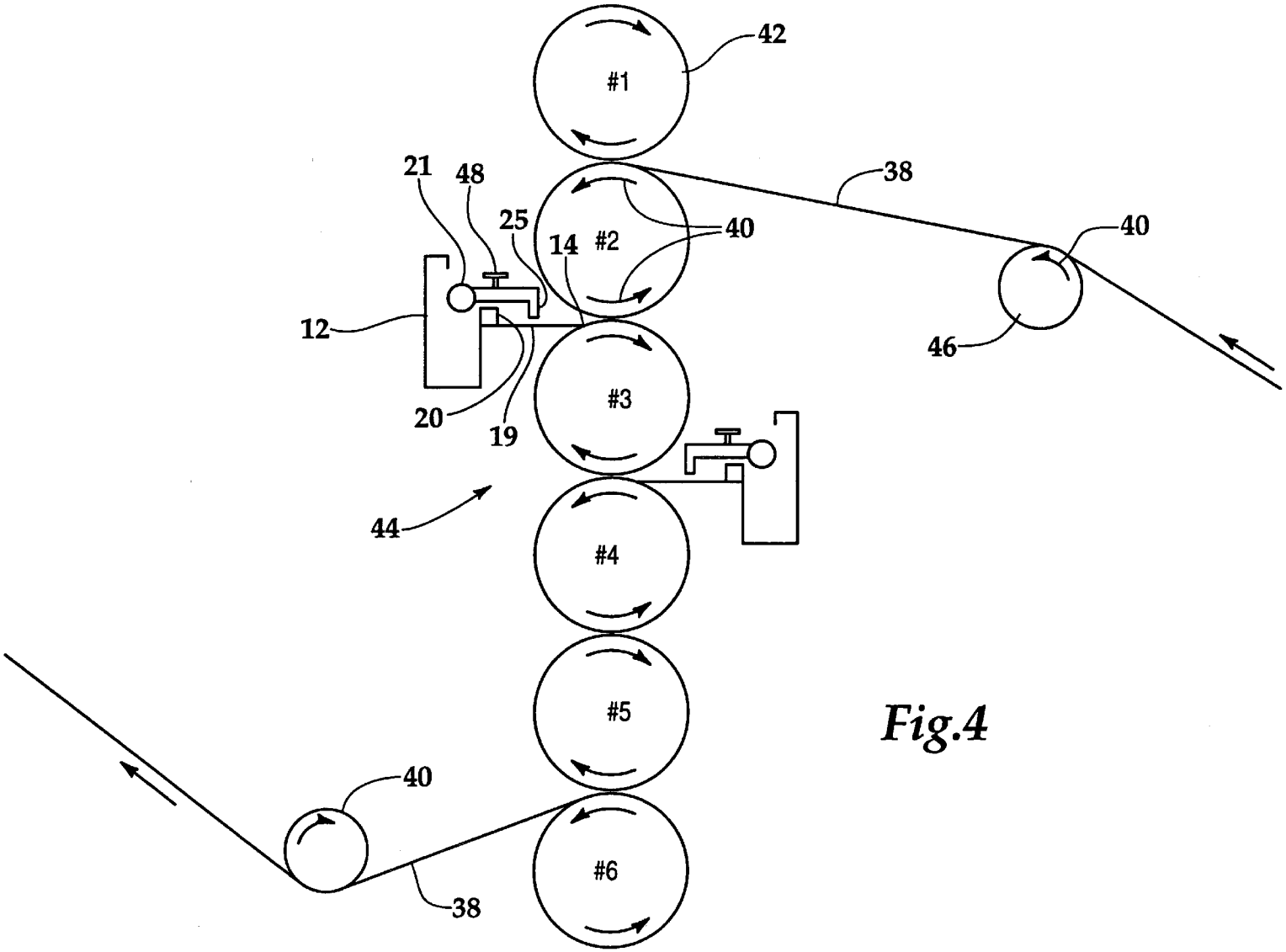
FIG. 4 is a schematic elevation view of multiple steel rolls.

Turning to FIG. 4, shown therein is a schematic elevational view of the multiple steel rolls 42 of the calendar stack generally shown at 44 showing a layer of paper 38 passing over a guide roll 46 along with direction arrows 40. Also shown is a valve 48 on nozzle 25 for turning it off and on and adjusting the flow of liquid therethrough. Other elements previously disclosed are also illustrated.

Figure 5:
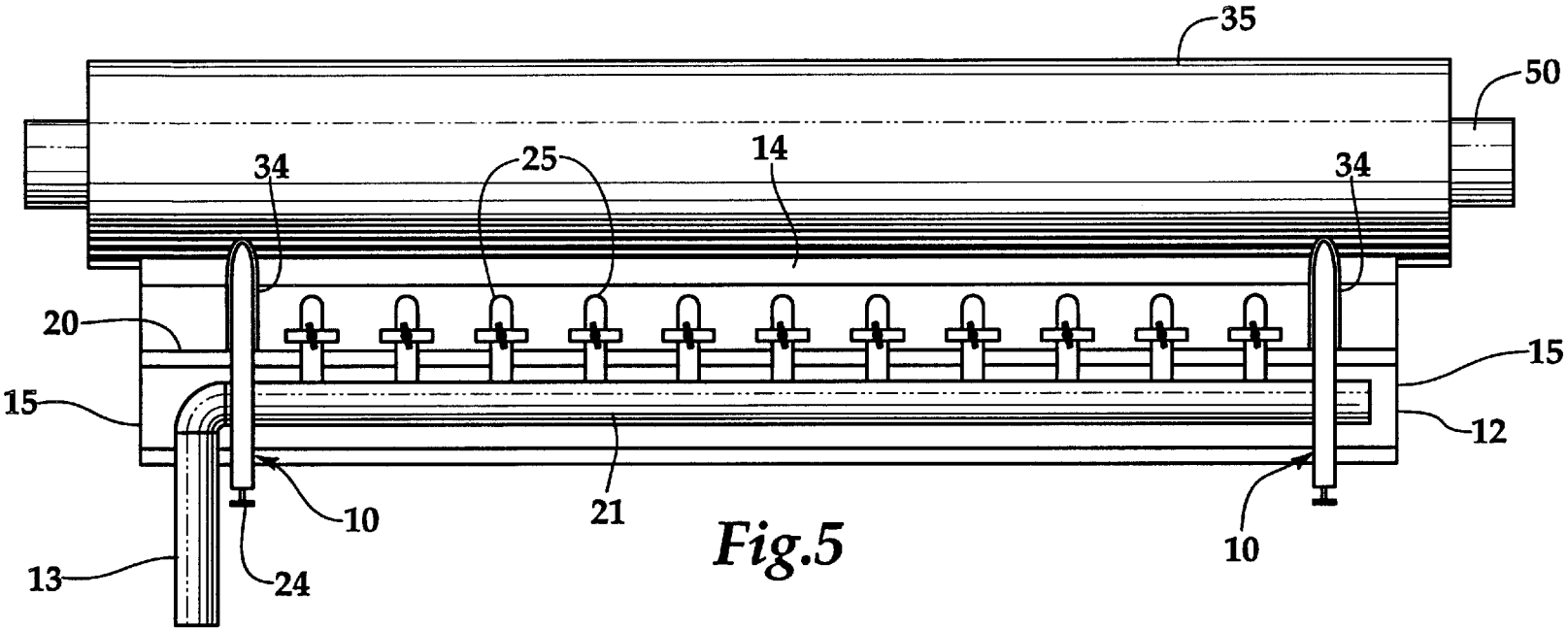
FIG. 5 is a plan view of the present invention in operative connection.

Turning to FIG. 5, shown therein is a plan view of the present invention in operative connection with the waterbox 12 along with a steel roll 35 and axle 50 thereof. Other elements previously disclosed are also shown. A pair of end dams 34 are shown on each end of the waterbox 12.

Figure 6:
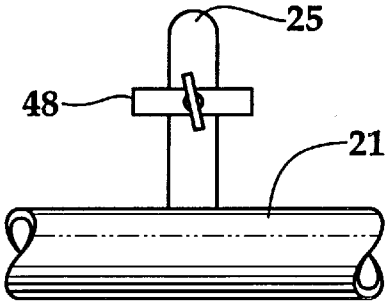
FIG. 6 is an enlarged view of a nozzle taken from FIG. 5 as indicated.

Turning to FIG. 6, shown therein is an enlarged view of the nozzle 25 taken from FIG. 5 as indicated, along with valve 48 and conduit 21.

Figure 7:
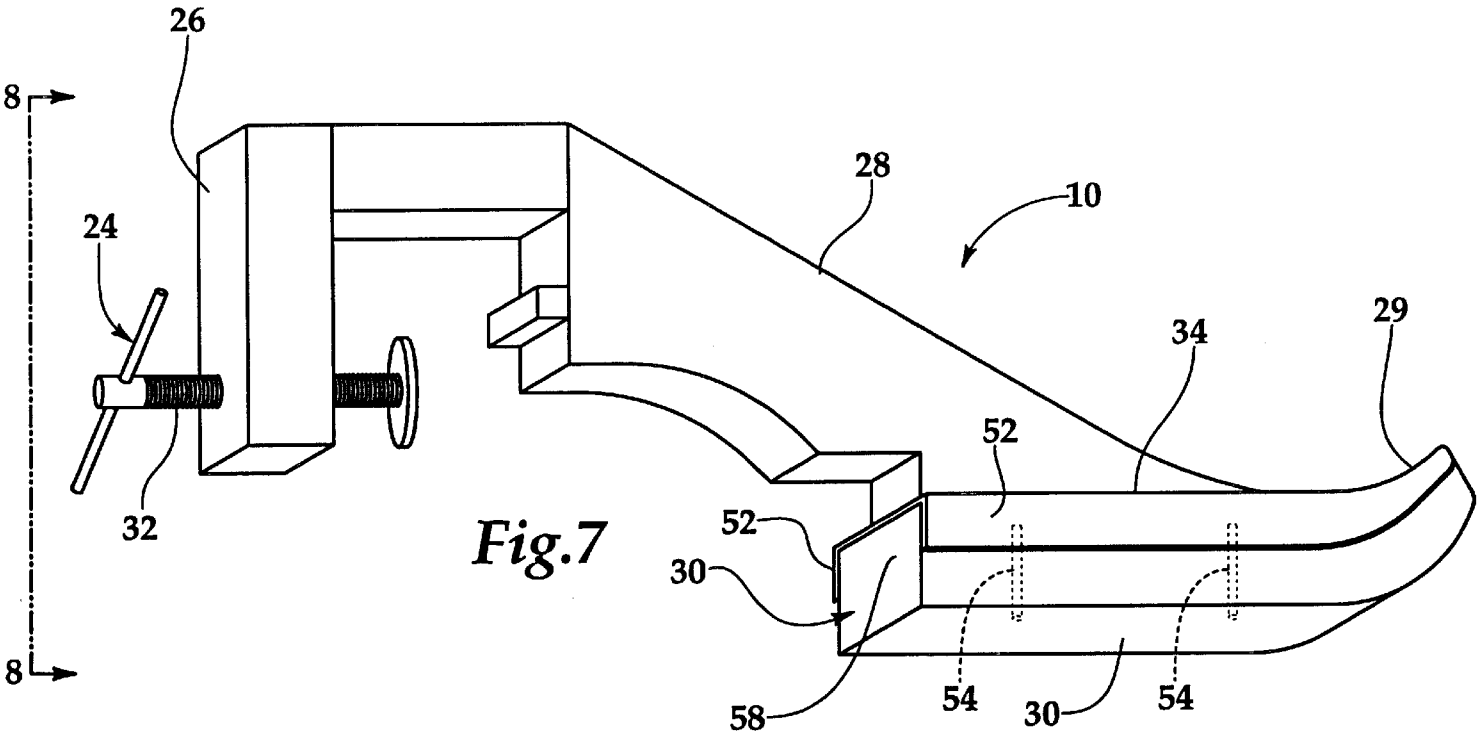
FIG. 7 is a side rear perspective of the present invention.

Turning to FIG. 7, shown therein is a rear side perspective of the present invention 10 showing a more detailed view of foot 34 and the means for attaching 31 the packing 30 (not shown) to foot 34. Means 31 comprises a pair of downwardly extending flanges 52 on each lateral edge of foot 34 running longitudinally along the underside and extending for almost the entire length of foot 34. Multiple pins 54 are disposed perpendicular to the underside of foot 34 for insertion into packing material 30 with packing material 30 being held by and frictionally disposed between flanges 52 whereby pins 54 assist in removably attaching packing material 30 to foot 34. By way of explanation of the means of attaching 31, the horizontal distance between the pair of flanges 52 is about $^{15}/_{16}$ inches and the packing material is about 1 inch wide, i.e., has a horizontal distance measurement of about 1 inch, whereby when the packing material 30 is placed into the channel 58 formed by flanges 52 the packing material 30 is removably firmly attached to foot 34. Pins 54 have means for attachment 60 to foot 34 such as welding. Alternatively, it may be possible to use glue to attach said packing material 30 to said foot-like member 34.

Figure 8:
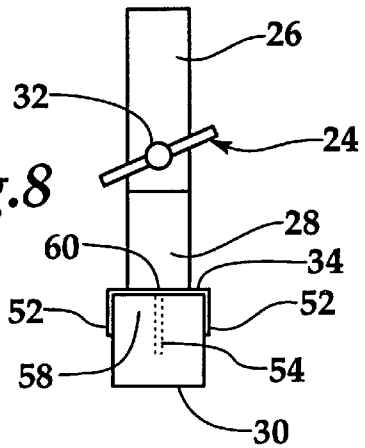
FIG. 8 is an rear elevation of the present invention.

Turning to FIG. 8, shown therein is an elevational view of the rear of the present invention 10, taken from FIG. 7 as indicated. Shown are the clamp 24, clamp handle 56, thread means 32, body 28, foot 34 being generally a horizontal plate having a pair of flanges 52 downwardly extending along with pin 54 attached at 60 to foot 34. Channel 58 is shown wherein packing material 30 is attached. By way of illustration, the vertical thickness of packing material 30 as shown in FIG. 8 is about 1 inch and the vertical length of the pair of flanges 52 is about ½ inch which provides about ½ inch length of packing material extending below foot 34 to provide the seal between foot 34 and roll 35 (not shown).

Figure 9:
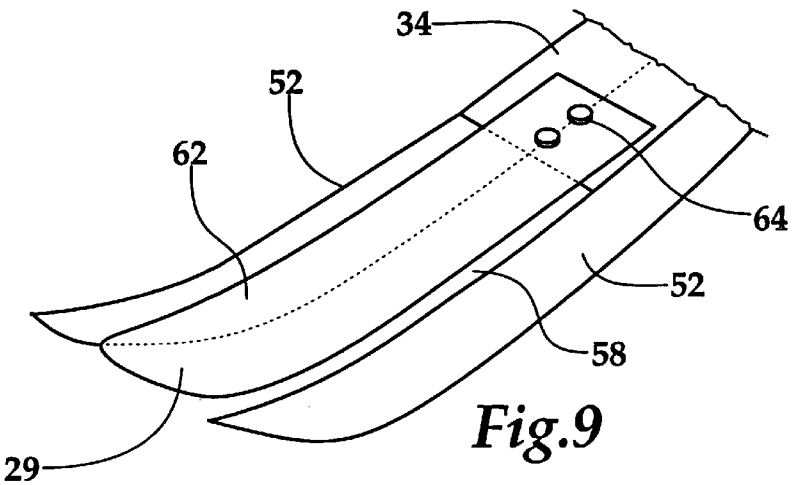
FIG. 9 is a detailed view of the present invention taken from FIG. 2 as indicated.

Turning to FIG. 9, shown therein is a detailed view taken from FIG. 2 as indicated showing another embodiment of the present invention 10. Shown therein is the forwardly extending front curved tip 29 portion of foot 34 with flanges 52 and channel 58 therebetween. Also shown is a spring tensioning means 62 being, e.g., a flat leaf spring having means for attachment 64 to the top of foot 34 whereby when packing material 30 (not shown) is placed in channel 58 and attached as previously described to foot 34, spring means 62 presses downwardly against the top of packing material 30 so as to gently but firmly urge packing material 30 toward roll 35 so as to form a tight and leak-resistant end dam between foot 34 and roll 35. Spring means 62 could be made of steel, plastic or like durable, resilently flexible material. Note that the spring means 62 is positioned between the two flanges 52 and fits in the position normally occupied by the top of the foot 34, i.e., the top of the foot 34 is open on its top surface between the flanges 52 in this embodiment for receiving said spring means 62 so that the spring means 62 can contact the packing material 30 (not shown).

What is claimed to be new and desired to be protected by Letters Patent is set forth in the claims:

1. An apparatus for an end dam to contain liquid in a waterbox on a papermaking machine, comprising:

a) a main body member, said main body member having an underside;

b) a first means for attaching said main body member to a waterbox;

c) means for sealing attached to said main body member;

d) a second means for attaching said means for sealing to said main body member;

e) said means for sealing being positioned on the underside of said main body member;

f) said second means for attaching being positioned on the underside of said main body member; and g) said main body member having a forwardly projecting foot portion having an upwardly curved end, said means for sealing having one upwardly curved end, said means for sealing being attached to said foot portion with said curved end of said means for sealing in contact with a steel roll of a paper making machine said means for sealing forming an end dam in said waterbox.

2. The apparatus of claim 1, said first means for attaching further comprising a threaded member.

3. The apparatus of claim 2, said first means for attaching further comprising a clamp.

4. The apparatus of claim 3, said first means for attaching being downwardly extending from said main body member.

5. The apparatus of claim 1, said means for sealing further comprising soft, pliable material.

6. The apparatus of claim 5, wherein said means for sealing further comprising packing material.

7. The apparatus of claim 1, further comprising a water box, said water box having a forwardly extending shelf portion thereon, said shelf portion extending across the full width of said waterbox, said shelf portion having a pond level control dam positioned thereon extending across the full width of said waterbox for retaining the liquid in the waterbox, said means for sealing extending from said pond level control dam to said steel roll of a paper making machine, said means for sealing forming an end dam extending from said pond level control dam to said steel roll.

8. The apparatus of claim 7, further comprising an end dam on each end of said waterbox, said pair of end dams containing liquid on said shelf portion of said waterbox.

9. The apparatus of claim 1, further comprising said foot portion having lateral edges, further said foot portion having a pair of downwardly extending flanges on said lateral edges of said foot portion, said flanges disposed longitudinally along the entire length of said foot portion, a channel defined by said foot portion and said pair of downwardly extending flanges, said means for sealing being attached interior of said channel.

10. The apparatus of claim 9, further comprising at least one pin having a third means for attaching to the underside of said foot portion, said pin positioned interior of said channel, said pin disposed perpendicular to said foot portion, said pin extending into said means for sealing, said means for sealing being attached to said foot portion.

11. The apparatus of claim 9, said means for sealing having a width slightly greater than said channel, said means for sealing being frictionally held in said channel.

12. The apparatus of claim 1, further comprising means for tensioning downwardly said upwardly curved end of said means for sealing, said means for tensioning urging said means for sealing toward said steel roll of said paper making machine.

13. The apparatus of claim 12, said foot portion having an opening in its upper surface for receiving said means for tensioning, said means for tensioning further comprising a flat spring leaf, said flat spring leaf downwardly urging said means for sealing toward said steel roll of said paper making machine.

* * * * *